US006305362B1

(12) United States Patent
Kitamura et al.

(10) Patent No.: US 6,305,362 B1
(45) Date of Patent: Oct. 23, 2001

(54) EVAPORATIVE EMISSION CONTROL SYSTEM FOR INTERNAL COMBUSTION ENGINE

(75) Inventors: Toru Kitamura; Norio Suzuki; Naohiro Kurokawa; Tetsuya Ishiguro, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/605,059

(22) Filed: Jun. 28, 2000

(30) Foreign Application Priority Data

Jul. 26, 1999 (JP) ..... 11-211073

(51) Int. Cl.[7] ..... F02M 37/04
(52) U.S. Cl. ..... 123/520; 123/516
(58) Field of Search ..... 123/520, 519, 123/518, 516, 198 D, 521

(56) References Cited

U.S. PATENT DOCUMENTS 5,174,265 * 12/1992 Sekine ..... 123/520
5,353,770 * 10/1994 Osanai et al. ..... 123/520
5,918,581 * 7/1999 Uto et al. ..... 123/520
6,047,692 * 4/2000 Toyoda ..... 123/698
6,092,515 * 7/2000 Morikawa ..... 123/698
6,105,556 * 8/2000 Takaku et al. ..... 123/520
6,189,515 * 2/2001 Jamrog et al. ..... 123/520

FOREIGN PATENT DOCUMENTS 11-50919 2/1999 (JP) .

* cited by examiner

*Primary Examiner*—Carl S. Miller
(74) *Attorney, Agent, or Firm*—Arent, Fox, Kintner, Plotkin & Kahn, PLLC

(57) ABSTRACT

Disclosed herein is an evaporative emission control system which can properly control the ratio between a tank purge amount and a canister purge amount to realize quick pressure reduction in a fuel tank and ensuring the storage capacity of a canister in a well balanced fashion. A target pressure in controlling the pressure in the fuel tank at a negative pressure and a detected pressure in the fuel tank are compared with each other. When the difference between the target pressure and the detected pressure is large, tank purge is preferentially carried out to open a tank pressure control valve. When the detected pressure is in the vicinity of the target pressure, canister purge is preferentially carried out to purge the evaporative fuel stored in the canister.

18 Claims, 10 Drawing Sheets

EVAPORATIVE EMISSION CONTROL SYSTEM FOR INTERNAL COMBUSTION ENGINE

BACKGROUND OF THE INVENTION

The present invention relates to an evaporative emission control system for an internal combustion engine, and more particularly to such a system that the emission of evaporative fuel is prevented by maintaining the pressure in a fuel tank at a negative pressure.

For example, Japanese Patent Laid-open No. 11-50919 discloses an evaporative emission control system including a passage for connecting a fuel tank directly to an intake system of an internal combustion engine (this passage will be hereinafter referred to as "first evaporative fuel passage") to maintain the pressure in the fuel tank at a negative pressure (a pressure lower than the atmospheric pressure). This conventional system further includes a canister for temporarily storing evaporative fuel, and a passage for connecting the fuel tank through the canister to the intake system of the internal combustion engine (this passage will be hereinafter referred to as "second evaporative fuel passage"). With this configuration, tank purge for purging the evaporative fuel from the fuel tank through the first evaporative fuel passage to the intake system and canister purge for purging the evaporative fuel stored in the canister through the second evaporative fuel passage to the intake system can be carried out in parallel.

In the above conventional system, however, the flow of the evaporative fuel in the tank purge and the canister purge is set to such an amount that having almost no effects on air-fuel ratio control for the engine. Accordingly, in the case that the pressure in the fuel tank is equal to the atmospheric pressure or in the case that the canister is in a full-charged condition, much time is required for each purge.

Further, in the above conventional system, a canister purge amount, i.e., an evaporative fuel amount to be supplied to the intake system by the canister purge, is first determined. Then, the canister purge amount is subtracted from a maximum evaporative fuel amount that can be purged to determine a tank purge amount, i.e., an evaporative fuel amount to be supplied to the intake system by the tank purge. As a result, the tank purge amount is relatively small, causing a delay of pressure reduction in the fuel tank. Conversely, in the case of adopting a method of preferentially determining the tank purge amount, there occurs another problem that the canister purge amount becomes lacking to cause a reduction in storage capacity of the canister (especially, the storage capacity required in refueling).

SUMMARY OF THE INVENTION

It is accordingly an object of the present invention to provide an evaporative emission control system which can properly control the ratio between the tank purge amount and the canister purge amount to realize quick pressure reduction in the fuel tank and ensuring the storage capacity of the canister in a well balanced manner.

In accordance with the present invention, there is provided in an evaporative emission control system for an internal combustion engine, including a first evaporative fuel passage for connecting a fuel tank and an intake system of said internal combustion engine, a first control valve provided in said first evaporative fuel passage for opening and closing said first evaporative fuel passage, first control means for controlling the opening degree of said first control valve so that the pressure in said fuel tank becomes lower than an atmospheric pressure, a second evaporative fuel passage for connecting said fuel tank and said intake system, a canister provided in said second evaporative fuel passage for temporarily storing evaporative fuel, a second control valve for opening and closing said second evaporative fuel passage, and second control means for controlling the opening degree of said second control valve; the improvement comprising target pressure setting means for setting a target pressure in said fuel tank; tank pressure detecting means for detecting the pressure in said fuel tank; and third control means for comparing said target pressure with said detected pressure in said fuel tank and controlling said first control means and said second control means according to the result of comparison between said target pressure and said detected pressure.

With this configuration, the first and second control means are controlled according to the result of comparison between the target pressure and the detected pressure in the fuel tank. Accordingly, when the detected pressure in the fuel tank is in the vicinity of the atmospheric pressure and much higher than the target pressure, tank purge through the first control valve is preferentially carried out. Conversely, when the detected pressure in the fuel tank is near the target pressure, canister purge through the second control valve is preferentially carried out. Accordingly, quick pressure reduction in the fuel tank and ensuring the storage capacity of the canister can be realized in a well balanced manner.

Preferably, the third control means controls the first and second control means so that the amount of evaporative fuel to be purged through the first evaporative fuel passage is decreased and the amount of evaporative fuel to be purged through the second evaporative fuel passage is increased with a decrease in the detected pressure toward the target pressure.

Preferably, the required fuel amount is determined according to an operating condition of the internal combustion engine, a corrective fuel amount is calculated according to the amount of evaporative fuel to be purged through the first evaporative fuel passage, and a fuel amount obtained by correcting the required fuel amount by the corrective fuel amount is supplied to the internal combustion engine.

Accordingly, it is possible to prevent the deviation of an air-fuel ratio from a target value due to the execution of the tank purge in which an evaporative fuel amount is large, and it is also possible to increase the maximum of a total purge amount as the sum of the tank purge amount and the canister purge amount, thereby allowing quicker pressure reduction in the fuel tank and quicker canister purge.

Preferably, the fuel amount control means calculates the corrective fuel amount according to the expected evaporative fuel amount and a delay of change in actual evaporative fuel amount from a change in the opening degree of the first control valve.

Preferably, the fuel amount control means calculates the expected evaporative fuel amount according to the difference between the pressure in the fuel tank and the pressure in the intake system, the opening degree of the first control valve, and the concentration of evaporative fuel generated in the fuel tank.

Preferably, the fuel amount control means calculates the concentration of the evaporative fuel according to the pressure in the fuel tank and the temperature of fuel in the fuel tank.

Preferably, the target pressure setting means corrects the target pressure according to the temperature of fuel in the fuel tank.

Preferably, the first control means sets an initial opening degree of the first control valve in the case of opening the first control valve from its closed condition, according to the difference between the pressure in the fuel tank and the pressure in the intake system.

Preferably, the first control means compares the expected evaporative fuel amount with a target evaporative fuel amount to be supplied through the first evaporative fuel passage to the intake system, and controls the opening degree of the first control valve according to the result of comparison between the expected evaporative fuel amount and the target evaporative fuel amount.

Preferably, the first control means corrects the opening degree of the first control valve according to the rotational speed of the internal combustion engine.

Other objects and features of the invention will be more fully understood from the following detailed description and appended claims when taken with the accompanying drawings.

DETAILED DESCRIPTION OF THE PREFERRED EMBODIMENTS

A preferred embodiment of the present invention will now be described with reference to the drawings.

Figure 1:
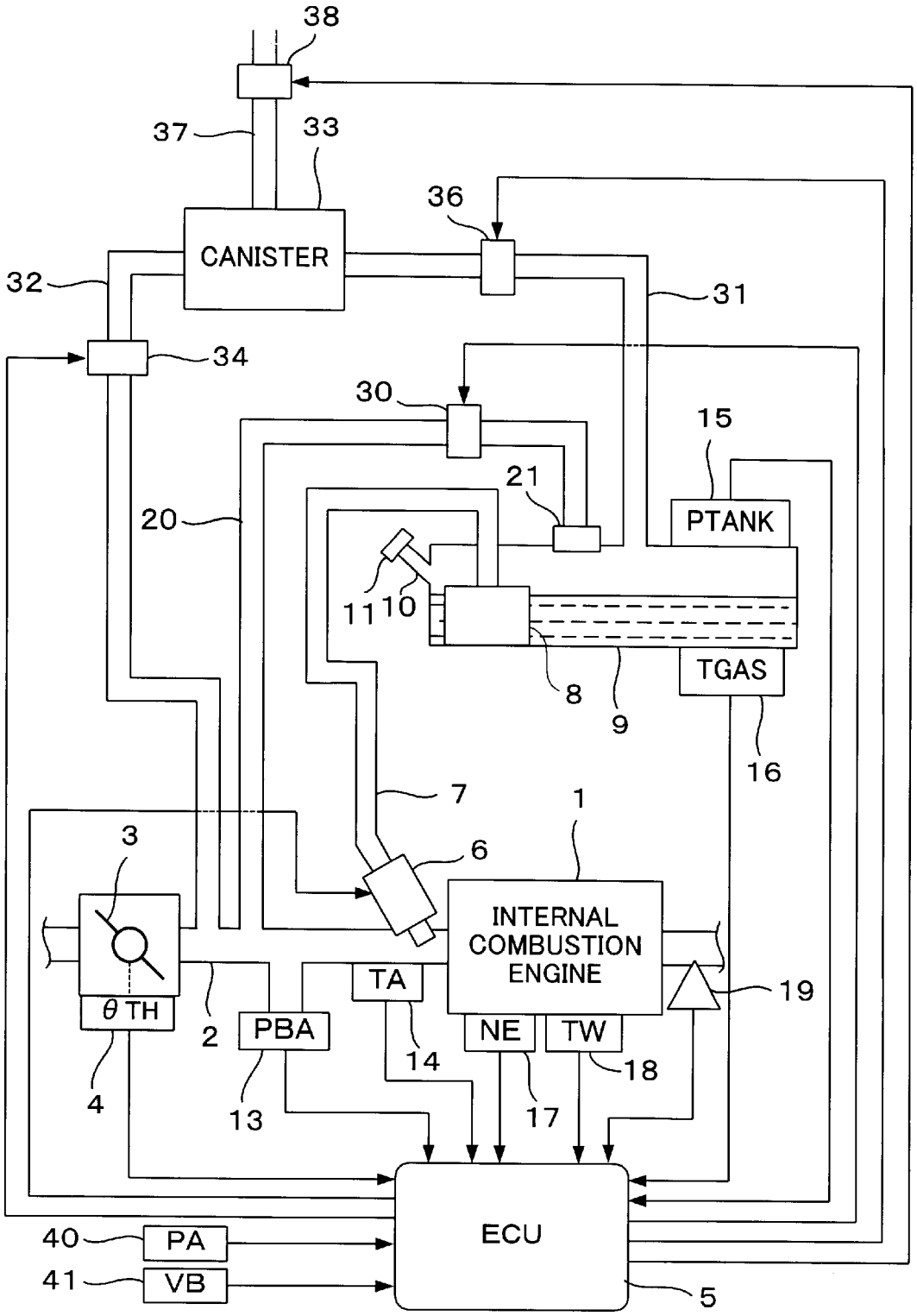
FIG. 1 is a schematic diagram showing the configuration of an evaporative emission control system according to a preferred embodiment of the present invention.

FIG. 1 is a schematic diagram showing the configuration of an evaporative emission control system for an internal combustion engine according to a preferred embodiment of the present invention. Referring to FIG. 1, reference numeral 1 denotes an internal combustion engine (which will be hereinafter referred to simply as "engine") having a plurality of (e.g., four) cylinders. The engine 1 is provided with an intake pipe 2, in which a throttle valve 3 is mounted. A throttle valve opening θTH sensor 4 is connected to the throttle valve 3. The throttle valve opening sensor 4 outputs an electrical signal corresponding to the opening angle of the throttle valve 3 and supplies the electrical signal to an electronic control unit (which will be hereinafter referred to as "ECU") 5.

Fuel injection valves, only one of which is shown, are inserted into the intake pipe 2 at locations intermediate between the cylinder block of the engine 1 and the throttle valve 3 and slightly upstream of the respective intake valves (not shown). All the fuel injection valves 6 are connected through a fuel supply pipe 7 to a fuel pump unit 8 provided in a fuel tank 9 having a hermetic structure. The fuel pump unit 8 is configured by integrating a fuel pump, a fuel strainer, and a pressure regulator having a reference pressure set to an atmospheric pressure or tank internal pressure. The fuel tank 9 has a fuel inlet 10 for use in refueling, and a filler cap 11 is mounted on the fuel inlet 10.

Each fuel injection valve 6 is electrically connected to the ECU 5, and its valve opening period is controlled by a signal from the ECU 5. The intake pipe 2 is provided with an intake pipe absolute pressure PBA sensor 13 for detecting an absolute pressure PBA in the intake pipe 2 and an intake air temperature TA sensor 14 for detecting an air temperature TA in the intake pipe 2 at positions downstream of the throttle valve 3. The fuel tank 9 is provided with a tank pressure sensor 15 as the tank pressure detecting means for detecting a pressure in the fuel tank 9, i.e., a tank pressure PTANK, and a fuel temperature TGAS sensor 16 for detecting a fuel temperature TGAS in the fuel tank 9.

An engine rotational speed NE sensor 17 for detecting an engine rotational speed is disposed near the outer periphery of a camshaft or a crankshaft (both not shown) of the engine 1. The engine rotational speed sensor 17 outputs a pulse (TDC signal pulse) at a predetermined crank angle per 180° rotation of the crankshaft of the engine 1. There are also provided an engine coolant temperature sensor 18 for detecting a coolant temperature TW of the engine 1 and an oxygen concentration sensor (which will be hereinafter referred to as "LAF sensor") 19 for detecting an oxygen concentration in exhaust gases from the engine 1. Detection signals from these sensors 13 to 19 are supplied to the ECU 5. The LAF sensor 19 functions as a wide-area air-fuel ratio sensor adapted to output a signal substantially proportional to an oxygen concentration in exhaust gases (proportional to an air-fuel ratio of air-fuel mixture supplied to the engine 1).

There will now be described a configuration for reducing the pressure in the fuel tank 9 to a negative pressure. The fuel tank 9 is connected through a first evaporative fuel passage 20 to the intake pipe 2 at a position downstream of the throttle valve 3. The first evaporative fuel passage 20 is provided with a tank pressure control valve 30 as the first control valve for opening and closing the first evaporative fuel passage 20 to control the pressure in the fuel tank 9. The tank pressure control valve 30 is a solenoid valve for controlling the flow of evaporative fuel from the fuel tank 9 to the intake pipe 2 by changing the on-off duty ratio of a control signal received (the opening degree of the first control valve ). The operation of the control valve 30 is controlled by the ECU 5. The control valve 30 may be a linearly controlled type solenoid valve whose opening degree is continuously changeable.

A cut-off valve 21 is provided at the connection between the evaporative fuel passage 20 and the fuel tank 9. The cut-off valve 21 is a float valve adapted to be closed when the fuel tank 9 is filled up or when the inclination of the fuel tank 9 is increased.

There will now be described a configuration for preventing the emission of evaporative fuel in the fuel tank 9 into the atmosphere in refueling. A canister 33 is connected through a charging passage 31 to the fuel tank 9, and is also connected through a purging passage 32 to the intake pipe 2 at a position downstream of the throttle valve 3. In this preferred embodiment, the charging passage 31 and the purging passage 32 correspond to the second evaporative fuel passage defined in the present invention.

The charging passage 31 is provided with a charge control valve 36. The operation of the charge control valve 36 is controlled by the ECU 5 in such a manner that the charge control valve 36 is opened in refueling to introduce the evaporative fuel from the fuel tank 9 to the canister 33, and is otherwise closed. In this preferred embodiment, however, the charge control valve 36 is opened also at idling of the engine 1, so as to reduce the pressure in the fuel tank 9 to a negative pressure through the canister 33.

The canister 33 contains active carbon for adsorbing the evaporative fuel in the fuel tank 9. The canister 33 is adapted to communicate with the atmosphere through a vent passage 37.

The vent passage 37 is provided with a vent shut valve 38. The vent shut valve 38 is a normally closed valve, and its operation is controlled by the ECU 5 in such a manner that the vent shut valve 38 is opened in refueling or during purging, and is otherwise closed. However, the vent shut valve 38 is closed at idling of the engine 1 when reduction of pressure in the fuel tank 9 to a negative pressure through the canister 33 is carried out.

The purging passage 32 connected between the canister 33 and the intake passage 2 is provided with a purge control valve 34 as the second control valve. The purge control valve 34 is a solenoid valve capable of continuously controlling the flow by changing the on-off duty ratio of a control signal received (the opening degree of the second control valve). The operation of the purge control valve 34 is controlled by the ECU 5.

The ECU 5 includes an input circuit having various functions including a function of shaping the waveforms of input signals from the various sensors, a function of correcting the voltage levels of the input signals to a predetermined level, and a function of converting analog signal values into digital signal values, a central processing unit (which will be hereinafter referred to as "CPU"), storage means preliminarily storing various operational programs to be executed by the CPU and for storing the results of computation or the like by the CPU, and an output circuit for supplying drive signals to the fuel injection valves 6, the tank pressure control valve 30, the purge control valve 34, the charge control valve 36, and the vent shut valve 38.

For example, the CPU of the ECU 5 controls the amount of fuel to be supplied to the engine 1 according to output signals from the various sensors including the engine rotational speed sensor 17, the intake pipe absolute pressure sensor 13, and the engine coolant temperature sensor 18. More specifically, the CPU of the ECU 5 calculates a required fuel amount TiREQ in accordance with Eq. (1) and corrects the required fuel amount TiREQ by a fuel amount TiVAC purged through the evaporative fuel passage 20 (the fuel amount TiVAC will be hereinafter referred to as "tank purge fuel amount" or "corrective fuel amount") in accordance with Eq. (2) to calculate a valve opening period (a fuel injection period) TOUT of each fuel injection valve 6. Each of the required fuel amount TiREQ and the tank purge fuel amount TiVAC is a parameter obtained by converting a mass fuel amount into a fuel injection period of each fuel injection valve 6.

$$TiREQ=TIM\times KCMD\times KAF\times K1+K2 \quad (1)$$

$$TOUT=TiREQ-TiVAC \quad (2)$$

TIM is a fundamental fuel injection period of each fuel injection valve 6. and it is determined by searching a TI map set according to the engine rotational speed NE and the intake pipe absolute pressure PBA. The TI map is set so that the air-fuel ratio of a fuel mixture to be supplied to the engine becomes substantially equal to a stoichiometric air-fuel ratio in an operating condition according to the engine rotational speed NE and the intake pipe absolute pressure PBA on the map.

KCMD is a target air-fuel ratio coefficient, which is set according to engine operational parameters such as the engine rotational speed NE, the intake pipe absolute pressure PBA, and the engine coolant temperature TW. The target air-fuel ratio coefficient KCMD is proportional to the reciprocal of an air-fuel ration A/F, i.e., proportional to a fuel-air ratio F/A, and takes a value of 1.0 for a stoichiometric air-fuel ratio, so KCMD is referred to also as a target equivalent ratio.

KAF is an air-fuel ratio correction coefficient calculated by PID control so that a detected equivalent ratio KACT calculated from a detected value from the LAF sensor 19 becomes equal to the target equivalent ratio KCMD. The air-fuel ratio correction coefficient KAF is used to perform air-fuel ratio feedback control.

K1 and K2 are another correction coefficient and correction variable computed according to various engine parameter signals, respectively. These correction coefficient K1 and correction variable K2 are determined to such predetermined values as to optimize various characteristics such as fuel consumption characteristics and engine acceleration characteristics according to engine operating conditions.

Further, the CPU of the ECU 5 controls the operation of the various solenoid valves according to various conditions as in refueling or in the normal operation of the engine 1 in the following manner. In refueling, the charge control valve 36 and the vent shut valve 38 are opened as mentioned above. Accordingly, the evaporative fuel generated in the fuel tank 9 by refueling is stored into the canister 33 through the charge control valve 36, and the air separated from the fuel is released through the vent shut valve 38 into the atmosphere. Thus, the emission of the evaporative fuel into the atmosphere in refueling can be prevented.

In the normal operation of the engine 1, the charge control valve 36 is closed and the vent shut valve 38 is opened. In this condition, the purge control valve 34 is controlled to be opened to thereby apply the negative pressure in the intake pipe 2 to the canister 33. Accordingly, the atmospheric air is supplied through the vent shut valve 38 to the canister 33, and the fuel adsorbed by the canister 33 is purged through the purge control valve 34 into the intake pipe 2. Thus, the evaporative fuel generated in the fuel tank 9 is not released into the atmosphere, but is supplied to the intake pipe 2, then being subjected to combustion in the combustion chamber of the engine 1. Further, if predetermined conditions are satisfied in the normal operation of the engine 1, the tank purge control valve 30 is opened to apply the negative pressure in the intake pipe 2 directly to the fuel tank 9, thereby reducing the pressure in the fuel tank 9 to a negative pressure. In this preferred embodiment, the ratio between a canister purge amount through the purge control valve 34 and a tank purge amount through the tank pressure control valve 30 is controlled according to the deviation between a target pressure in the fuel tank 9 and a detected tank pressure PTANK.

Figure 2:
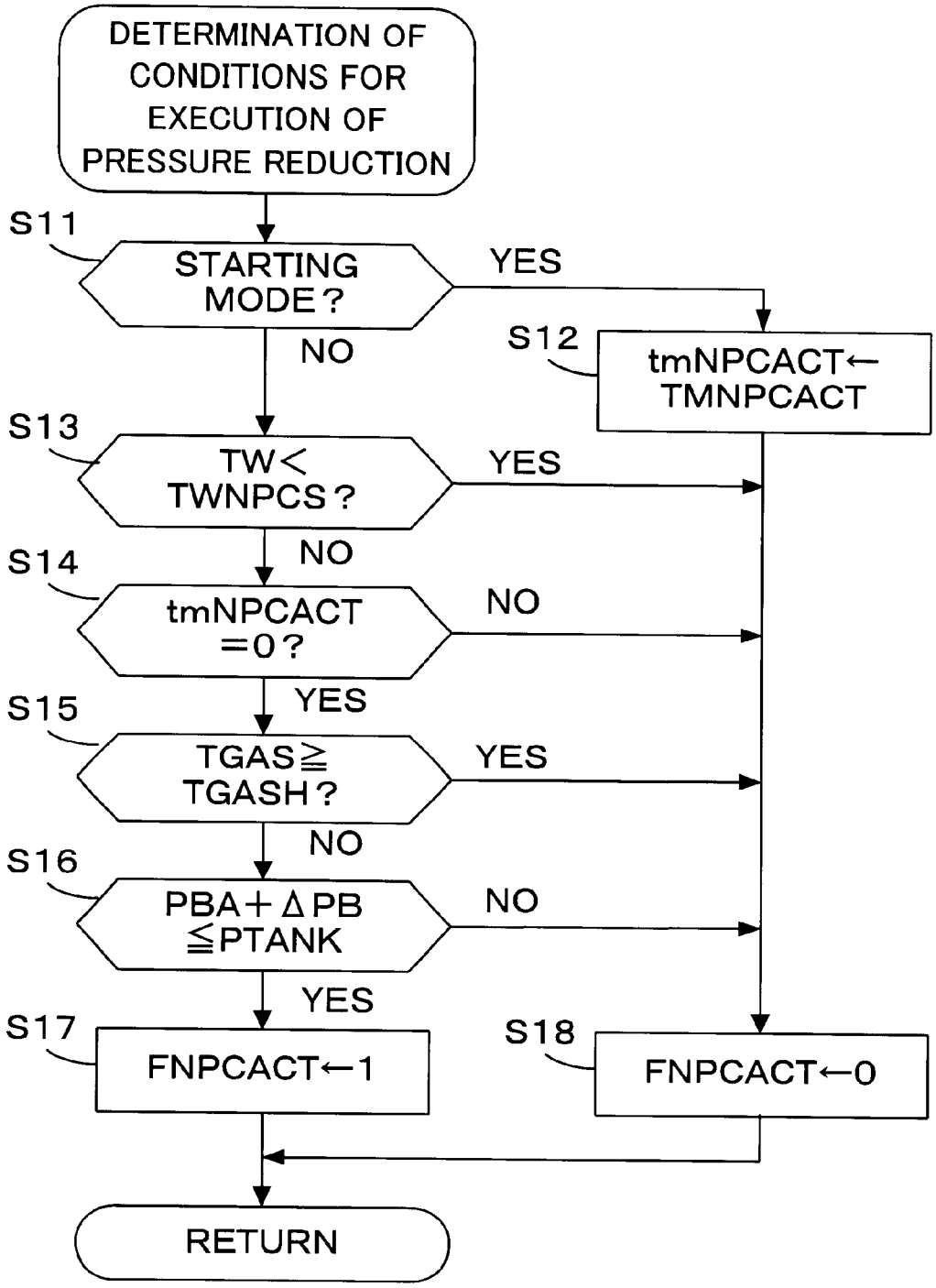
FIG. 2 is a flowchart showing the processing of determining the conditions for carrying out the pressure reduction in a fuel tank.

FIG. 2 is a flowchart showing the processing of determining the conditions for carrying out the pressure reduction in the fuel tank 9 through the evaporative fuel passage 20. This processing is executed by the CPU of the ECU 5 at predetermined time intervals (e.g., 82 msec).

In step S11, it is determined whether or not the engine 1 is in a starting mode, i.e., during cranking. If the engine 1 is in the starting mode, a predetermined time TMNPCACT (e.g.. 40 see) is set in a downcount timer tmNPCACT for measuring a time period after starting, and the downcount timer tmNPCACT is started (step S12). Then, a pressure reduction execution flag FNPCACT indicating the enabling of the pressure reduction (the opening operation of the tank pressure control valve 30) by "1" is set to "0" (step S18), and this processing is terminated.

If the engine 1 is not in the starting mode, it is determined whether or not the engine coolant temperature TW is lower than a predetermined coolant temperature TWNPCS (e.g., 65° C.) (step S13). If TW≧TWNPCS, it is determined whether or not the count value of the timer tmNPCACT started in step S12 becomes "0" (step S14). If TW<TWNPCS or tmNPCACT>0, the program proceeds to step S18 to disable the pressure reduction.

When the predetermined time TMNPCACT has elapsed after starting of the engine 1, the program proceeds from step S14 to step S15, in which it is determined whether or not the fuel temperature TGAS is higher than or equal to a predetermined fuel temperature TGASH (e.g., 40° C.). If TGAS<TGASH, it is determined whether or not the tank pressure PTANK is higher than or equal to the sum of the intake pipe absolute pressure PBA and a predetermined pressure ΔPB (e.g., 20 mmHg) (step S16). If TGAS≧TGASH or PTANK<PBA+ΔPB, the program proceeds to step S18 to disable the pressure reduction, whereas if TGAS<TGASH and PTANK≧PBA+ΔPB, the pressure reduction is enabled (step S17).

The predetermined fuel temperature TGASH is a lowermost fuel temperature at which vacuum boiling of the fuel tends to occur in the fuel pump 8 for pumping up the fuel from the fuel tank 9 in the case of carrying out the pressure reduction in the fuel tank 9, and this fuel temperature TGASH is set to 40° C. for example. The temperature of distillation of 10% of gasoline for use in summer is about 50° C. under the atmospheric pressure, and the target pressure in the fuel tank 9 is about 460 mmHg. Therefore, if the fuel temperature TGAS is lower than or equal to 40° C., the distillation can be suppressed to 10% or less. In other words, the predetermined fuel temperature TGASH may be regarded also as a temperature at which the distillation of the fuel in the fuel tank 9 can be suppressed to 10% or less.

By providing step S15 to disable the pressure reduction, i.e., the opening operation of the tank pressure control valve 30 if the fuel temperature TGAS is higher than or equal to the predetermined fuel temperature TGASH, vacuum boiling of the fuel in the fuel pump 8 can be prevented to ensure smooth fuel supply to each fuel injection Valve 6 and also to prevent that the amount of volatile components evaporating from the fuel may be increased to cause the difficulty of atomization of the fuel to be injected from each fuel injection valve 6. Although the pressure reduction in the fuel tank 9 is disabled in the case that the fuel temperature TGAS is higher than or equal to the predetermined fuel temperature TGASH, the pressure in the fuel tank 9 is reduced by the consumption of the fuel, because the fuel tank 9 has a hermetic structure. Therefore, the tank pressure PTANK does not become higher than or equal to the atmospheric pressure.

Further, the provision of step S16 for enabling the pressure reduction in the case that the tank pressure PTANK is higher than the intake pipe absolute pressure PBA by the predetermined pressure ΔPB or more is due to the following reason. The intake pipe absolute pressure PBA always varies according to engine operating conditions. Accordingly, if the pressure reduction is enabled in the case that the tank pressure PTANK is higher than the intake pipe absolute pressure PBA as in the conventional system, there may be a case that in the open condition of the tank pressure control valve 30, the intake pipe absolute pressure PBA becomes higher than the tank pressure PTANK during the period between successive executions of the processing shown in FIG. 2, causing an increase in the tank pressure PTANK. In this preferred embodiment, the pressure reduction is enabled only in the case that the tank pressure PTANK is higher than the intake pipe absolute pressure PBA by the predetermined pressure ΔPB or more, so that the above case can be reliably avoided. The predetermined pressure ΔPB is set to a value slightly larger than a maximum value of possible changes In the intake pipe absolute pressure PBA during the period between successive executions of the processing shown in FIG. 2. There is a pressure difference ΔPDET between the detected intake pipe absolute pressure PBA and an actual intake pipe absolute pressure due to a sensor response delay or a delay caused by a sampling period of sensor output. In consideration of the pressure difference ΔPDET, the predetermined pressure ΔPB may be set to a value slightly larger than a maximum pressure assumed as the pressure difference ΔPDET.

Figure 3:
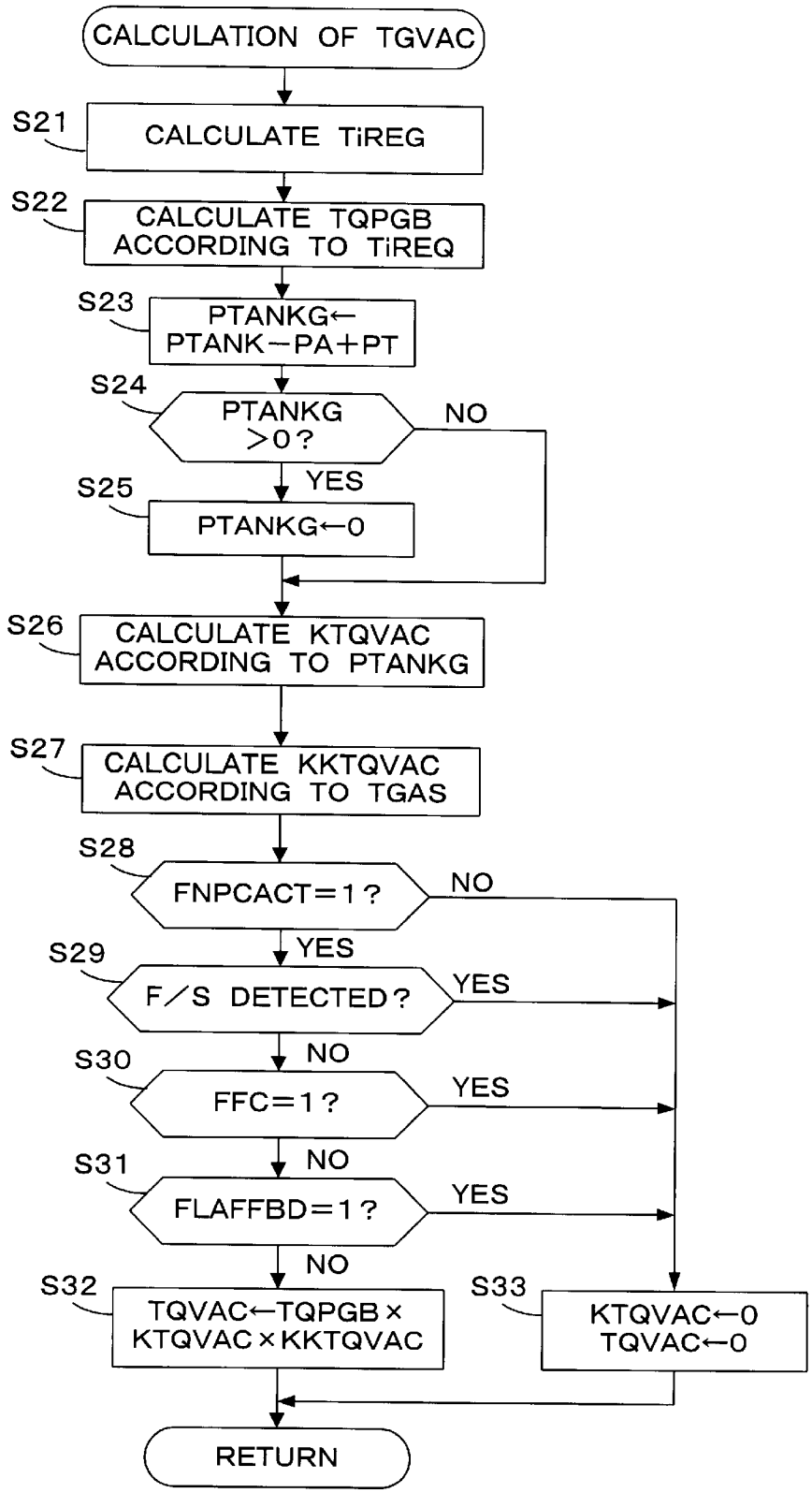
FIG. 3 is a flowchart showing the processing of calculating a target tank purge fuel amount TQVAC.

FIG. 3 is a flowchart showing the processing of calculating a target tank purge fuel amount TQVAC as a target value of the amount of fuel to be supplied through the evaporative fuel passage 20 to the intake pipe 2. This processing is executed by the CPU of the ECU 5 at predetermined time intervals (e.g., 82 msec). The target tank purge fuel amount TQVAC and a target purge fuel amount TOPGB to be hereinafter describes have the same dimension as that of the required fuel amount TiREQ, that is, they are converted into a valve opening period of the fuel injection valve 6.

Figure 4A:
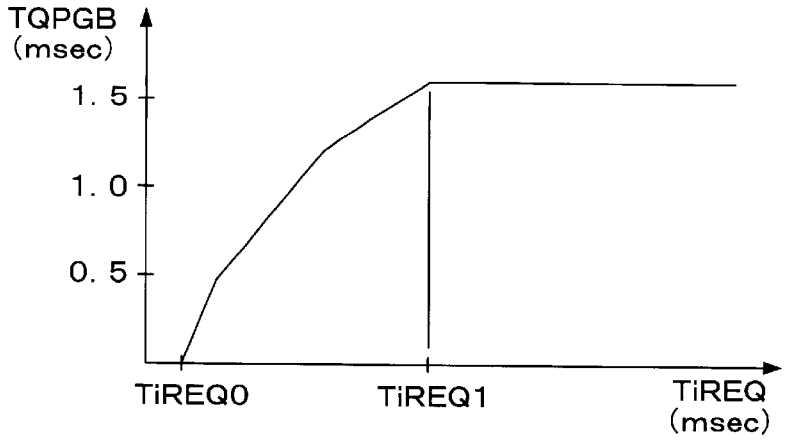
FIGS. 4A to 4D are graphs showing tables used for the processing shown in FIG. 3.

In step S21, a required fuel amount TiREQ is calculated in accordance with Eq. (1) mentioned above. Then, a TQPGB table shown in FIG. 4A is retrieved according to the required fuel amount TiREQ to calculate a target purge fuel amount TQPGB (step S22). The target purge fuel amount TQPGB corresponds to the sum of a target tank purge fuel amount TQVAC to be supplied through the evaporative fuel passage 20 to the intake pipe 2 and a target canister purge fuel amount TQCPG to be purged from the canister 33. In other words, the target purge fuel amount TOPGB corresponds to a maximum allowable value of the fuel amount to be supplied not through the fuel injection valves 6 to the engine 1. The TQPGB table is set so that the target purge fuel amount TQPGB increases with an increase in the required fuel amount TiREQ in the range of TiREQ≧TiREQ1 and is constant (TQPGB=1.5 msec) in the range of TiREQ>TiREQ1. Further, in the range of TiREQ<TiREQ0, the fuel amount to be injected from each fuel injection valve 6 is small, so that the target purge fuel amount TQPGB is set to 0. The predetermined fuel amounts TiREQ0 and TiREQI are set to 1 msec and 8 msec, respectively, for example.

Figure 4B:
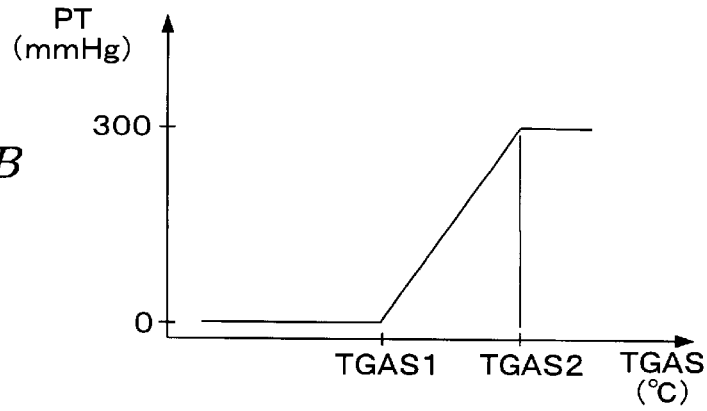

In step S23, a gauge pressure PTANKG is calculated in accordance with Eq. (3).

$$PTANKG=PTANK-PA+PT \quad (3)$$

where PA is an atmospheric pressure, and PT is a target pressure correction value calculated by retrieving a PT table set according to fuel temperature TGAS as shown in FIG. 4B. By adding the target pressure correction value PT, a target pressure in the fuel tank 9 is equivalently corrected in a pressure reducing direction. The PT table is set so that PT=0 in the range of TGAS<TGAS1 and PT increases with a rise in the fuel temperature TGAS in the range of TGAS1≧TGAS≧TGAS2. The predetermined temperatures TGAS1 and TGAS2 are set to 30° C. and 50° C. respectively, for example.

Figure 4C:
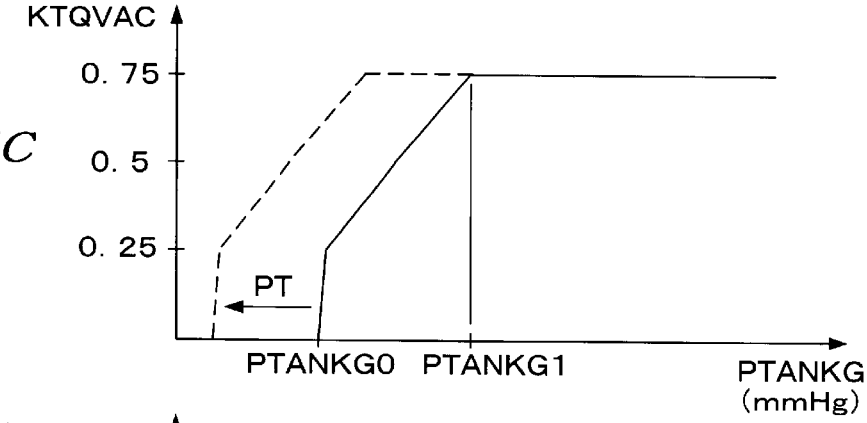

In step S24, it is determined whether or not the gauge pressure PTANKG is greater than 0. If PTANKG≧0, the program proceeds directly to step S26, whereas if PTANKG>0, PTANKG is set to 0 (step S25), and the program proceeds to step S26. In step S26, a KTQVAC table shown in FIG. 4C is retrieved according to the gauge pressure PTANKG to calculate a tank purge rdtio KTQVAC. The tank purge ratio KTQVAC is the ratio of the target tank purge fuel amount TQVAC to the target purge fuel amount TQPGB. The KTQVAC table is set so that KTQVAC=0 in the range of PTANKG<PTANKG0, KTQVAC increases with an increase in the gauge pressure PTANKG in the range of PTANKG0≧PTANKG≧PTANKG1, and KTQVAC=0.75 in the range of PTANKG>PTANKG1. The predetermined pressures PTANKG0 and PTANKG1 are set to −300 mmHg and 215 mmHg, respectively, for example.

Figure 4D:
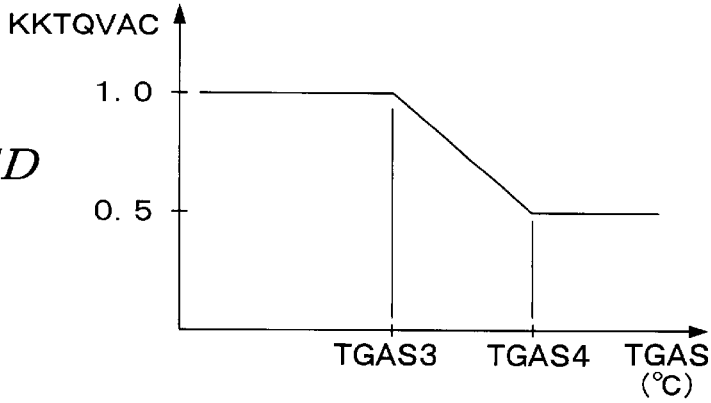

In step S27, a KKTQVAC table shown in FIG. 4D is retrieved according to the fuel temperature TGAS to calculate a correction coefficient KKTQVAC. The KKTQVAC table is set so that KKTQVAC=1 in the range of TGAS<TGAS3, KKTQVAC is decreased with a rise in the fuel temperature TGAS in the range of TGAS3≧TGAS≧TGAS4, and KKTQVAC=0.5 in the range of TGAS>TGAS4. The predetermined temperatures TGAS3 and TGAS4 are set to 33° C. and 62° C., respectively. for example.

In step S28, it is determined whether or not the pressure reduction execution flag FNPCACT is "1". If FNPCACT=1, it is determined whether or not any abnormal conditions of vacuum control related components including the tank pressure sensor 15 have been detected (step S29). If the abnormal conditions have not been detected, it is determined whether or not a fuel-cut operation for cutting off the fuel supply to the engine 1 is being carried out (step S30). If the fuel-cut operation is not being carried out, it is determined whether or not a feedback control start flag FLAFFBD indicating that air-fuel ratio feedback control has just started by "1" is "1" (step S31). If the pressure reduction execution flag FNPCACT is 1, the abnormal conditions have not been detected, the fuel-cut operation is not being carried out, and the air-fuel ratio feedback control has not just started; the target purge fuel amount TQPGB, the tank purge ratio KTQVAC, and the correction coefficient KKTQVAC are applied to Eq. (4) to calculate a target tank purge fuel amount TQVAC (step S32).

$$TQVAC=TQPGB\times KTQVAC\times KKTQVAC \quad (4)$$

If the answer to step S28 is negative (NO), or the answer to any one of steps S29 to S31 is affirmative (YES), both the tank purge ratio KTQVAC and the target tank purge fuel amount TQVAC are set to "0" (step S33), and this processing is terminated.

According to the processing shown in FIG. 3, when the tank pressure control valve 56 is opened to reduce the gauge pressure PTANKG down to the predetermined pressure PTANKG0 (which corresponds to the target pressure) or less, the tank purge ratio KTQVAC becomes 0, and accordingly the target tank purge fuel amount TQVAC becomes 0. As a result, the tank pressure control valve 30 is closed to maintain the gauge pressure PTANKG equal to PTANKG0. Further, by the addition of the target pressure correction value PT, it is possible to obtain an operation similar to that in which the setting of the KTQVAC table is equivalently shifted to a lower-pressure side by an amount corresponding to an increase in the gauge pressure PTANKG as shown by a broken line in FIG. 4° C. That is, the target pressure in the fuel tank 9 is shifted to a lower pressure by the target pressure correction value PT and the valve opening control for the tank pressure control valve 30 is executed until the gauge pressure PTANKG reaches the target pressure.

Figure 5:
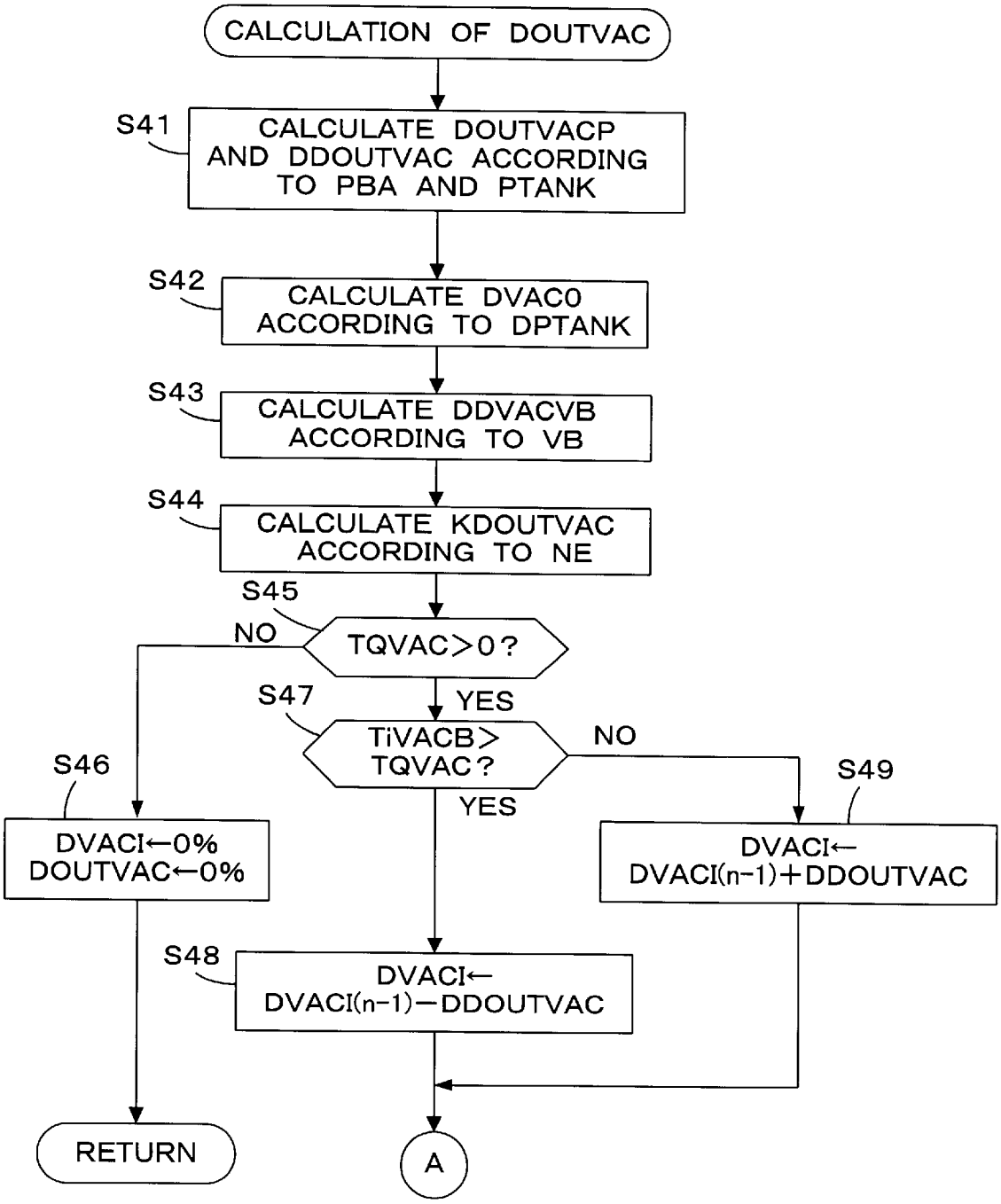
FIGS. 5 and 6 are flowcharts showing the processing of calculating an opening duty ratio DOUTVAC of a tank pressure control valve.
Figure 6:
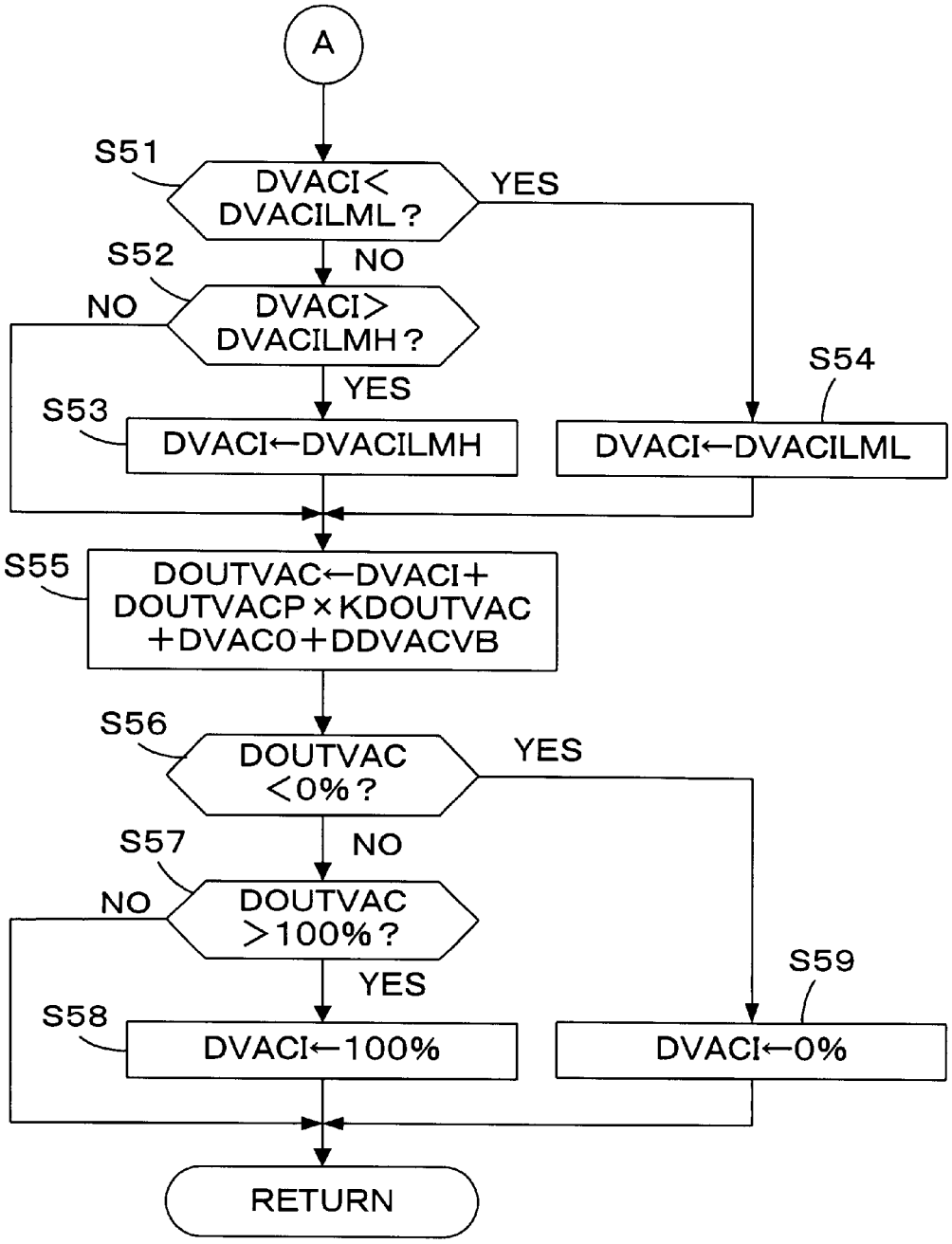

FIGS. 5 and 6 are flowcharts showing the processing of calculating an opening duty ratio DOUTVAC of the tank pressure control valve 30. This processing is executed by the CPU of the ECU 5 at predetermined time intervals (e.g., 82 msec).

In step S41, a DOUTVACP map and a DDOUTVAC map are retrieved according to the intake pipe absolute pressure PBA and the tank pressure PTANK to calculate a proportional term DOUTVACP and an addition/subtraction term DDOUTVAC for an integral term DVACI used in step S55 (see FIG. 6) to be hereinafter described. The DOUTVACP map is set so that the proportional term DOUTVACP is increased with an increase in the intake pipe absolute pressure PBA and with an increase in the tank pressure PTANK. The DDOUTVAC map is set to that the addition/subtraction term DDOUTVAC is decreased with an increase in the intake pipe absolute pressure PBA and is increased with an increase in the tank pressure PTANK.

Figure 7A:
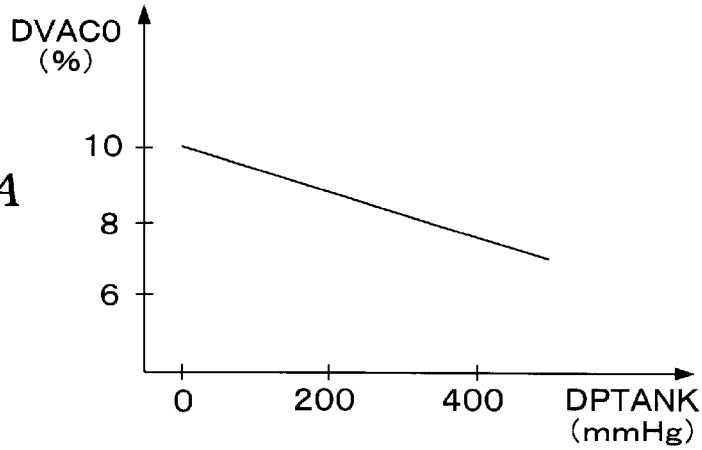
FIGS. 7A to 7C are graphs showing tables used for the processing shown in FIG. 5.

In step S42, a DVAC0 table shown in FIG. 7A is retrieved according to the pressure difference DPTANK (=PTANK−PBA) between the tank pressure PTANK and the intake pipe absolute pressure PBA to calculate an opening start duty ratio DVAC0 of the tank pressure control valve 30. The DVAC0 table is set so that the opening start duty ratio DVAC0 is decreased with an increase in the pressure difference DPTANK. The flow through the tank pressure control valve 30 increases with an increase in the pressure difference DPTANK in the condition that the opening degree of the pressure control valve 30 is fixed. Accordingly, the opening start duty ratio DVAC0 is decreased with an increase in the pressure difference DPTANK to thereby prevent that a large amount of fuel vapor may flow into the intake pipe 2 at starting to open the tank pressure control valve 30.

Figure 7B:
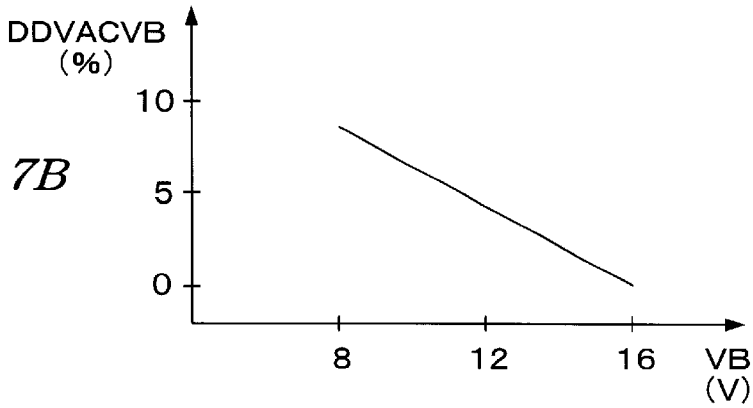

In step S43, a DDVACVB table shown in FIG. 7B is retrieved according to battery voltage VB to calculate a battery voltage correction term DDVACVB. The battery voltage correction term DDVACVB is provided for the purpose of correcting the operation of the tank pressure control valve 30 influenced by changes in battery voltage VB to thereby obtain a desired flow. The DDVACVB table is set so that the correction term DDVACVB is increased with a decrease In the battery voltage VB.

Figure 7C:
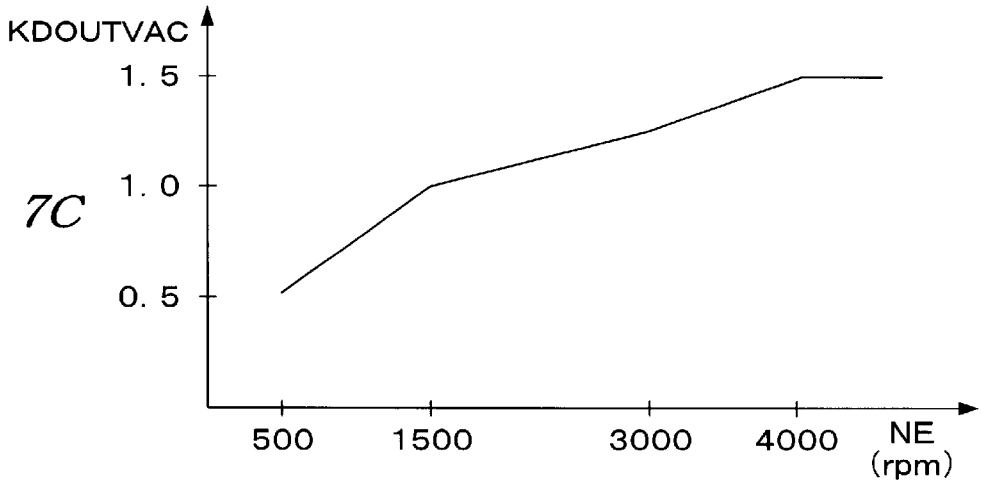

In step S44, a KDOUTVAC table shown in FIG. 7C is retrieved according to the engine rotational speed NE to calculate a rotational speed correction coefficient KDOUTVAC. The KDOUTVAC table is set so that the correction coefficient KDOUTVAC is increased with an increase in the engine rotational speed NE.

In step S45, it is determined whether or not the target tank purge fuel amount TQVAC calculated by the processing shown in FIG. 3 is larger than 0. If TQVAC=0, both the integral term DVACI and the opening duty ratio DOUTVAC are set to 0 (step S46), and this processing is terminated.

If TQVAC>0, it is determined whether or not the target tank purge fuel amount TQVAC is smaller than an expected tank purge fuel amount TiVACB calculated by the processing shown in FIG. 9 to be hereinafter described (step S47). If TQVAC<TiVACB, the integral term DVACI is calculated in accordance with Eq. (5) (step S48), whereas if TQVAC≧TiVACB, the integral term DVACI is calculated in accordance with Eq. (6) (step S49).

$$DVACI=DVACI(n-1)-DDOUTVAC \quad (5)$$

$$DVACI=DVACI(n-1)+DDOUTVAC \quad (6)$$

where (n−1) is affixed to indicate a previous value. By executing steps S47 to S49, the integral term DVACI is corrected by the addition/subtraction term DDOUTVAC so that the expected tank purge fuel amount TiVACB becomes equal to the target tank purge fuel amount TQVAC.

In steps S51 to S54 (see FIG. 6), the integral term DVACI is subjected to limit processing. That is, if the integral term DVACI is smaller than a lower limit DVACILML, DVACI is set to the lower limit DVACILML (steps S51 and S54). If the integral term DVACI is larger than an upper limit DVACILMH, DVACI is set to the upper limit DVACILMH (steps S52 and S53). If the integral term DVACI is in the range from the lower limit to the upper limit, the program proceeds directly to step S55.

In step S55, the integral term DVACI, the proportional term DOUTVACP, the correction coefficient KDOUTVAC, the opening start duty ratio DVAC0, and the battery correction term DDVACVB are applied to Eq. (7) to calculate an opening duty ratio DOUTVAC.

$$DOUTVAC = DVACI + DOUTVACP \times KDOUTVAC + DVACO + DDVACVB \quad (7)$$

In steps S56 to S59, the opening duty ratio DOUTVAC is subjected to limit processing. If the opening duty ratio DOUTVAC is smaller than 0%, DOUTVAC is set to 0% (steps S56 and S59). If the opening duty ratio DOUTVAC is larger than 100%, DOUTVAC is set to 100% (steps S57 and S58). If the opening duty ratio DOUTVAC is in the range of 0 to 100%, this program is immediately terminated.

By executing the processing shown in FIGS. 5 and 6, the opening duty ratio DOUTVAC of the tank pressure control valve 30 is controlled so that the expected tank purge fuel amount TiVACB becomes equal to the target tank purge fuel amount TQVAC.

Figure 8:
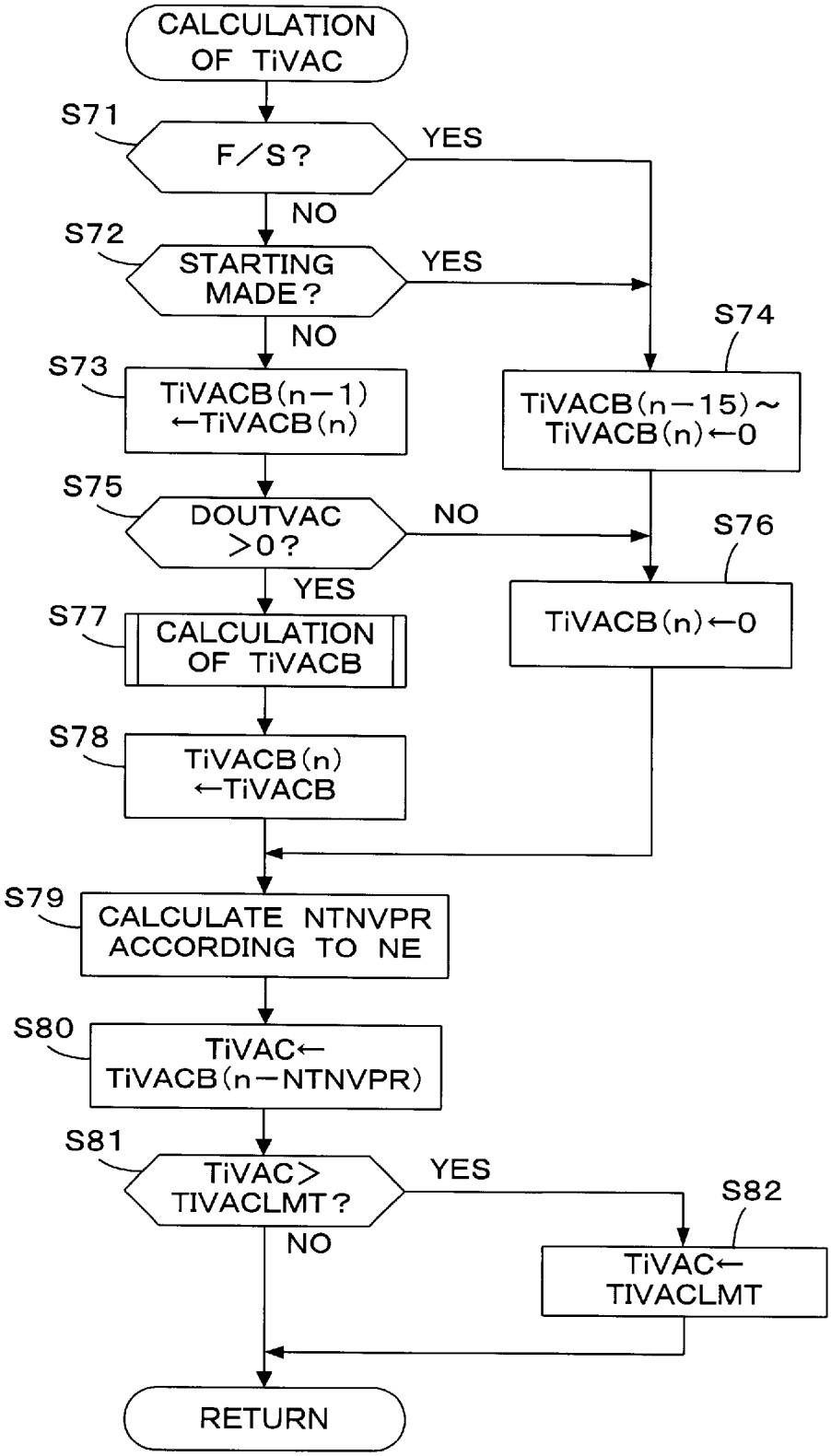
FIG. 8 is a flowchart showing the processing of calculating a fuel amount to be supplied through the tank pressure control valve to an intake pipe, which fuel amount is converted into an injection period of fuel injection valves.

FIG. 8 is a flowchart showing the processing of calculating an expected tank purge fuel amount TiVACB to store it into a ring buffer and selecting one of plural values of the expected tank purge amount TiVACB stored in the ring buffer according to engine rotational speed NE to calculate a corrective fuel amount (tank purge fuel amount) TiVAC. This processing is executed by the CPU of the ECU 5 in synchronism with the generation of a TDC signal pulse.

In step S71 like step S29 shown in FIG. 3, it is determined whether or not any abnormal conditions of vacuum control related components including the tank pressure sensor 15 have been detected. If the abnormal conditions have not been detected, it is determined whether or not the engine 1 is in the starting mode (step S72). If the abnormal conditions have been detected or the engine 1 is in the starting mode, all of stored values TiVACB(n−15) to TiVACB(n) in the ring buffer capable of storing 16 values of the expected tank purge fuel amount TiVACB are set to "0" (steps S74 and S76), and the program proceeds to step S79.

If the abnormal conditions have not been detected and the engine 1 is not in the starting mode, the present value (the latest value) TiVACB(n) of the expected tank purge fuel amount is set to the previous value TiVACB(n−1) (step S73). Then, it is determined whether or not the opening duty ratio DOUTVAC is larger than 0, that is, the tank pressure control valve 30 is to be opened (step S75). If DOUTVAC=0, the expected tank purge fuel amount TiVACB(n) is set to 0 (step S76), and the program proceeds to step S79.

Figure 9:
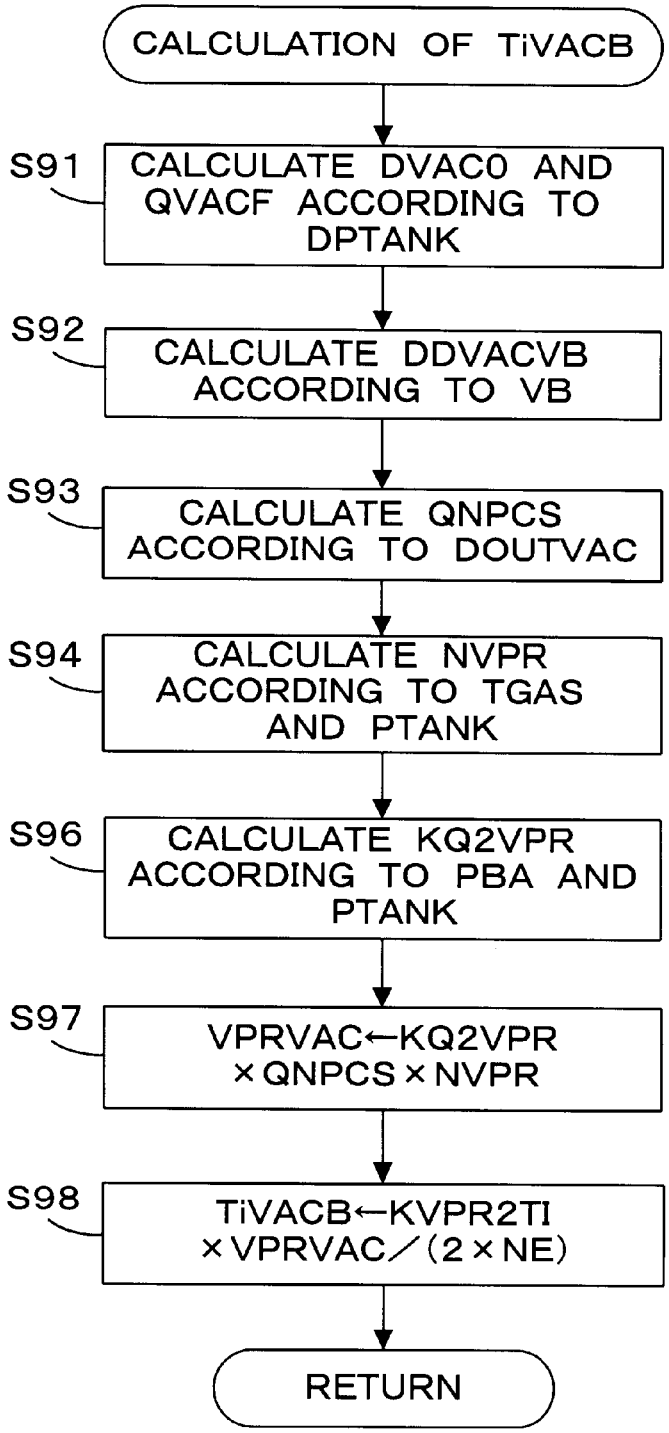
FIG. 9 is a flowchart showing the processing of calculating an expected tank purge fuel amount.

If DOUTVAC>0, the processing of calculating TiVACB shown in FIG. 9 is executed (step S77), and the latest value of TiVACB calculated in step S77 is stored as the present value TiVACB(n) into the ring buffer (step S78).

Figure 10A:
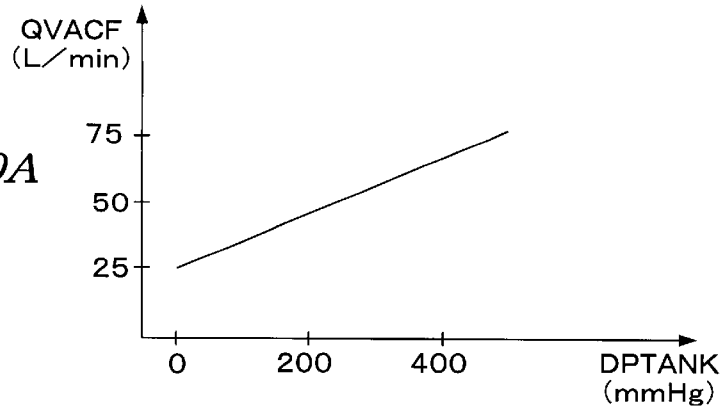
FIGS. 10A and 10B are graphs showing tables used for the processings shown in FIGS. 8 and 9.
Figure 10B:
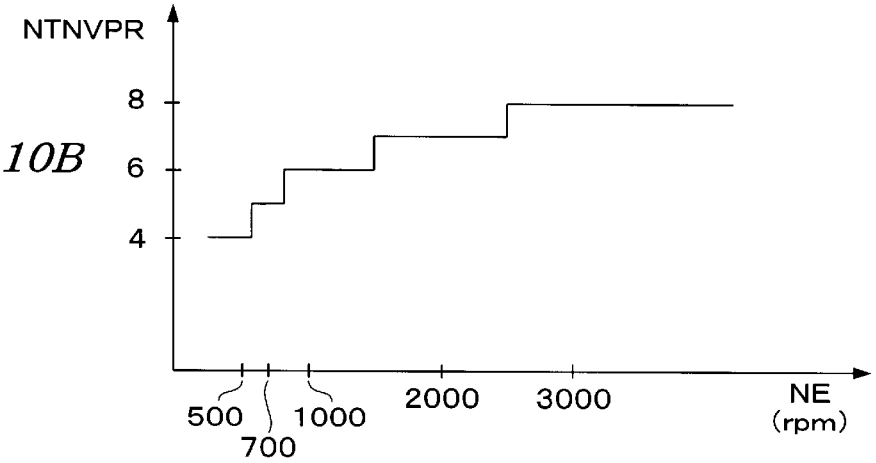

In step S79, an NTNVPR table shown in FIG. 10B is retrieved according to engine rotational speed NE to calculate a lag TDC number NTNVPR. The NTNVPR table is set so that the lag TDC number NTNVPR is increased with an increase in engine rotational speed NE. There is a time lag from the time the opening degree of the tank pressure control valve 30 is changed to the time the purge fuel amount to be supplied to the intake pipe 2 is changed. When the time lag is converted into a TDC number (the number of TDC signal pulses generated), the TDC number increases with an increase in engine rotational speed NE.

In step S80, the expected tank purge fuel amount TiVACB (n−NTNVPR), which is obtained at a previous time defined by the lag TDC number NTNVPR and stored in the ring buffer, is set as a corrective fuel amount TiVAC. Then, it is determined whether or not the corrective fuel amount TiVAC is larger than an upper limit TIVACLMT (step S81). If TiVAC≧TIVACLMT, this processing is immediately terminated, whereas if TiVAC>TIVACLMT, TiVAC is set to TIVACLMT (step S82), and this processing is subsequently terminated.

FIG. 9 is a flowchart showing the TiVACB calculation processing of step S77 shown in FIG. 8.

In step S91, the DVAC0 table shown in FIG. 7A is retrieved according to the pressure difference DPTANK (=PTANK−PBA) to calculate an opening start duty ratio DVAC0, and a QVACF table shown in FIG. IOA is retrieved according to the pressure difference DPTANK to calculate a full-open flow QVACF (L/min: Liter/minute) as a flow in the case of setting the opening duty ratio DOUTVAC to 100% (full-open condition). The QVACF table is set so that the full-open flow QVACF is increased with an increase in the pressure difference DPTANK.

In step S92, the DDVACVB table shown in FIG. 7B is retrieved according to the battery voltage VB to calculate a battery voltage correction term DDVACVB. Then, the opening duty ratio DOUTVAC, the opening start duty ratio DVAC0, the full-open flow QVACF, and the battery voltage correction term DDVACVB are applied to Eq. (8) to calculate a tank purge flow QNPCS (L/min) (step S93).

$$QNPCS=(DOUTVAC-DVAC0-DDVACVB)\times QVACF/(100-DVAC0) \quad (8)$$

In step S94, an NVPR map is retrieved according to the fuel temperature TGAS and the tank pressure PTANK to calculate a vapor concentration NVPR (%). The NVPR map is set so that the vapor concentration NVPR is increased with a decrease in the tank pressure PTANK and an increase in the fuel temperature TGAS.

In step S96, a KQ2VPR map is retrieved according to the intake pipe absolute pressure PBA and the tank pressure PTANK to calculate a conversion coefficient KQ2VPR (g/L) for conversion of the volume of fuel vapor into a mass. The KQ2VPR map is set so that the conversion coefficient KQ2VPR is decreased with an increase in the intake pipe absolute pressure PBA and is increased with an increase in the tank pressure PTANK.

In step S97. the conversion coefficient KQ2VPR, the tank purge flow QNPCS, and the vapor concentration NVPR are applied to Eq. (9) to calculate a mass flow VPRVAC (g/min) of the tank purge fuel. Then, the mass flow VPRVAC is applied to Eq. (10) to be converted into a fuel injection period of the fuel injection valve 6, thus calculating an expected tank purge fuel amount TiVACB (step S98).

$$VPRVAC=KQ2VPR\times QNPCS\times NVPR \quad (9)$$

$$TiVACB=KVPR2TI\times VPRVAC/(2\times NE) \quad (10)$$

where KVPR2TI is a conversion coefficient determined by the characteristics of the fuel injection valve 6.

By applying the corrective fuel amount TiVAC calculated by the processing shown in FIGS. 8 and 9 to Eq. (2) mentioned above, a fuel amount obtained by subtracting, from the required fuel amount TiREQ, the tank purge fuel amount supplied to the intake pipe 2 by the execution of pressure reduction in the fuel tank can be supplied from the fuel injection valves 6, thereby effecting accurate air-fuel ratio control without the influence of tank purge. As a result, the target purge fuel amount TQPGB can be set relatively large as compared with the required fuel amount TiREQ, so that the pressure reduction in the fuel tank can be quickly performed.

Figure 11:
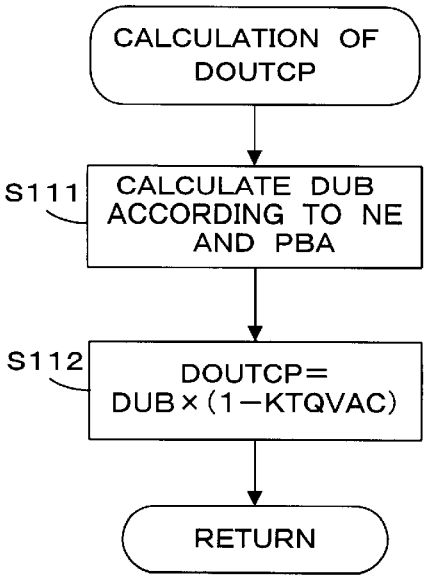
FIG. 11 is a flowchart showing the processing of calculating an opening duty ratio DOUTCP of a canister purge control valve.

FIG. 11 is a flowchart showing the processing of calculating an opening duty ratio DOUTCP of the purge control valve 34. This processing is executed by the CPU of the ECU 5 at predetermined time intervals (e.g., 82 msec).

In step S111, a DUB map is retrieved according to the engine rotational speed NE and the intake pipe absolute pressure PBA to calculate a map value DUB of the opening duty ratio. The DUB map is set so that the map value DUB is increased with an increase in the engine rotational speed NE and an increase in the intake pipe absolute pressure PBA.

In step S112, the map value DUB and the tank purge ratio KTQVAC calculated in step S26 shown in FIG. 3 are applied to Eq. (11) to calculate an opening duty ratio DOUTCP.

$$DOUTCP=DUB\times(1-KTQVAC) \quad (11)$$

According to the processing shown in FIG. 11, the opening duty ratio DOUTCP of the purge control valve 34 for controlling the purge from the canister 33 is decreased with an increase in the tank purge ratio KTQVAC. In other words, the opening duty ratio DOUTCP is increased with a decrease in the tank purge ratio KTQVAC. On the other hand, the tank purge ratio KTQVAC is decreased with a decrease in the gauge pressure PTANKG toward the target pressure PTANKG0, so that the canister purge ratio (1−KTQVAC) from the canister 33 is conversely increased. That is, the tank purge ratio KTQVAC is increased with an increase in the gauge pressure PTANKG from the target pressure PTANKG0, thereby accelerating the pressure reduction in the fuel tank. Conversely, the tank purge ratio KTQVAC is decreased with a decrease in the gauge pressure PTANKG toward the target pressure PTANKG0, thereby increasing the canister purge ratio (1−KTQVAC). Thus, the tank purge and the canister purge can be performed in a well balanced manner according to their requirement. As a result, both quick pressure reduction in the fuel tank and ensuring the storage capacity of the canister can be realized in a well balanced manner.

Further, the target pressure correction value PT is set according to the fuel temperature TGAS, thereby obtaining an operation similar to that wherein the target pressure PTANKG0 is decreased with an increase in the fuel temperature TGAS. Accordingly, even when the fuel temperature TGAS is high, the pressure in the fuel tank can be reliably maintained at a negative pressure after stopping the engine.

In this preferred embodiment, steps S23 and S26 shown in FIG. 3 correspond to the target pressure setting means; the processing shown in FIGS. 5 and 6 corresponds to the first control means; the processing shown in FIG. 11 corresponds to the second control means; and steps S26 and S32 shown in FIG. 3 and step S112 shown in FIG. 11 correspond to the third control means.

It should be noted that the present invention is not limited to the above preferred embodiment, but various modifications may be made. For example, while one of the conditions for enabling the pressure reduction in the fuel tank is that the fuel temperature TGAS is lower than the predetermined temperature TGASH set to about 40° C., for example (step S15 in FIG. 2) in the above preferred embodiment, the predetermined temperature TGASH may be set so as to be decreased with a decrease in ambient temperature in consideration of the fact that highly volatile fuel is supplied in winter. Thus, the predetermined fuel temperature TGASH may be set according to the volatility of fuel to be supplied.

The position of the tank pressure sensor 15 is not limited to that shown in FIG. 1, but it may be set in the charging passage 31 between the charge control valve 36 and the fuel tank 9, for example.

The charge control valve 36 and the vent shut valve 38 may be provided by relief valves as described in Japanese Patent Laid-open No. 11-50919.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In an evaporative emission control system for an internal combustion engine, including a first evaporative fuel passage for connecting a fuel tank and an intake system of said internal combustion engine, a first control valve provided in said first evaporative fuel passage for opening and closing said first evaporative fuel passage, first control means for controlling the opening degree of said first control valve so that the pressure in said fuel tank becomes lower than an atmospheric pressure, a second evaporative fuel passage for connecting said fuel tank and said intake system, a canister provided in said second evaporative fuel passage for temporarily storing evaporative fuel, a second control valve for opening and closing said second evaporative fuel passage, and second control means for controlling the opening degree of said second control valve; the improvement comprising:

target pressure setting means for setting a target pressure in said fuel tank;

tank pressure detecting means for detecting the pressure in said fuel tank; and third control means for comparing said target pressure with said detected pressure in said fuel tank and controlling said first control means and said second control means according to the result of comparison between said target pressure and said detected pressure.

2. An evaporative emission control system according to claim 1, wherein said third control means controls said first and second control means so that an evaporative fuel amount to be supplied through said first evaporative fuel passage to said intake system is decreased and an evaporative fuel amount to be supplied through said second evaporative fuel passage to said intake system is increased with a decrease in said detected pressure in said fuel tank toward said target pressure.

3. An evaporative emission control system according to claim 1, further comprising fuel amount control means for calculating a required fuel amount according to an operating condition of said internal combustion engine, calculating a corrective fuel amount according to an expected evaporative fuel amount to be supplied through said first evaporative fuel passage to said intake system, and supplying to said internal combustion engine a fuel amount obtained by correcting said required fuel amount by said corrective fuel amount.

4. An evaporative emission control system according to claim 2, further comprising fuel amount control means for calculating a required fuel amount according to an operating condition of said internal combustion engine, calculating a corrective fuel amount according to an expected evaporative fuel amount to be supplied through said first evaporative fuel passage to said intake system, and supplying to said internal combustion engine a fuel amount obtained by correcting said required fuel amount by said corrective fuel amount.

5. An evaporative emission control system according to claim 3, wherein said fuel amount control means calculates said corrective fuel amount according to said expected evaporative fuel amount and a delay of change in actual evaporative fuel amount from a change in the opening degree of said first control valve.

6. An evaporative emission control system according to claim 4, wherein said fuel amount control means calculates said corrective fuel amount according to said expected evaporative fuel amount and a delay of change in actual evaporative fuel amount from a change in the opening degree of said first control valve.

7. An evaporative emission control system according to claim 5, wherein said fuel amount control means calculates said expected evaporative fuel amount according to the difference between the pressure in said fuel tank and the pressure in said intake system, the opening degree of said first control valve, and the concentration of evaporative fuel generated in said fuel tank.

8. An evaporative emission control system according to claim 6, wherein said fuel amount control means calculates said expected evaporative fuel amount according to the difference between the pressure in said fuel tank and the pressure in said intake system, the opening degree of said first control valve, and the concentration of evaporative fuel generated in said fuel tank.

9. An evaporative emission control system according to claim 7, wherein said fuel amount control means calculates the concentration of said evaporative fuel according to the pressure in said fuel tank and the temperature of fuel in said fuel tank.

10. An evaporative emission control system according to claim 8, wherein said fuel amount control means calculates the concentration of said evaporative fuel according to the pressure in said fuel tank and the temperature of fuel in said fuel tank.

11. An evaporative emission control system according to claim 1, wherein said target pressure setting means corrects said target pressure according to the temperature of fuel in said fuel tank.

12. An evaporative emission control system according to claim 2, wherein said target pressure setting means corrects said target pressure according to the temperature of fuel in said fuel tank.

13. An evaporative emission control system according to claim 1, wherein said first control means sets an initial opening degree of said first control valve in the case of opening said first control valve from its closed condition, according to the difference between the pressure in said fuel tank and the pressure in said intake system.

14. An evaporative emission control system according to claim 2, wherein said first control means sets an initial opening degree of said first control valve in the case of opening said first control valve from its closed condition, according to the difference between the pressure in said fuel tank and the pressure in said intake system.

15. An evaporative emission control system according to claim 3, wherein said first control means compares said expected evaporative fuel amount with a target evaporative fuel amount to be supplied through said first evaporative fuel passage to said intake system, and controls the opening degree of said first control valve according to the result of comparison between said expected evaporative fuel amount and said target evaporative fuel amount.

16. An evaporative emission control system according to claim 4, wherein said first control means compares said expected evaporative fuel amount with a target evaporative fuel amount to be supplied through said first evaporative fuel passage to said intake system, and controls the opening degree of said first control valve according to the result of comparison between said expected evaporative fuel amount and said target evaporative fuel amount.

17. An evaporative emission control system according to claim 15, wherein said first control means corrects the opening degree of said first control valve according to the rotational speed of said internal combustion engine.

18. An evaporative emission control system according to claim 16, wherein said first control means corrects the opening degree of said first control valve according to the rotational speed of said internal combustion engine.

* * * * *